United States Patent [19]

Forbes, Jr.

[11] Patent Number: 4,657,143

[45] Date of Patent: Apr. 14, 1987

[54] POUR SPOUT CARTON

[75] Inventor: Hampton E. Forbes, Jr., Newark, Del.

[73] Assignee: Westvaco Corporation, New York, N.Y.

[21] Appl. No.: 854,563

[22] Filed: Apr. 22, 1986

[51] Int. Cl.[4] ..... B65D 5/70; B65D 5/74

[52] U.S. Cl. ..... 206/626; 206/621; 229/17 R

[58] Field of Search ..... 229/7 R, 17 R; 206/620, 206/621, 626

[56] References Cited

U.S. PATENT DOCUMENTS

| | | | |
|---|---|---|---|
| 2,132,925 | 10/1938 | Bensel | 229/17 R |
| 3,059,826 | 10/1962 | Harms | 229/17 R |
| 3,743,164 | 7/1973 | Clark | 229/17 R |
| 3,767,107 | 10/1973 | Forbes, Jr. | 229/17 R |
| 4,520,929 | 6/1985 | Lisiecki | 229/17 R |
| 4,582,246 | 4/1986 | Lisiecki | 229/17 R |

FOREIGN PATENT DOCUMENTS

| | | | |
|---|---|---|---|
| 435891 | 10/1935 | United Kingdom | 229/17 R |
| 562966 | 7/1944 | United Kingdom | 229/17 R |
| 733040 | 7/1955 | United Kingdom | 206/626 |

*Primary Examiner*—William Price
*Assistant Examiner*—Gary E. Elkins

[57] ABSTRACT

A carton for packaging granular or powdered materials is provided which includes a self-contained, reclosable pour spout. The carton is formed from a single blank of foldable sheet material which includes sift proof tabs in the top closure and a ripped opening flap covering the pour spout.

2 Claims, 11 Drawing Figures

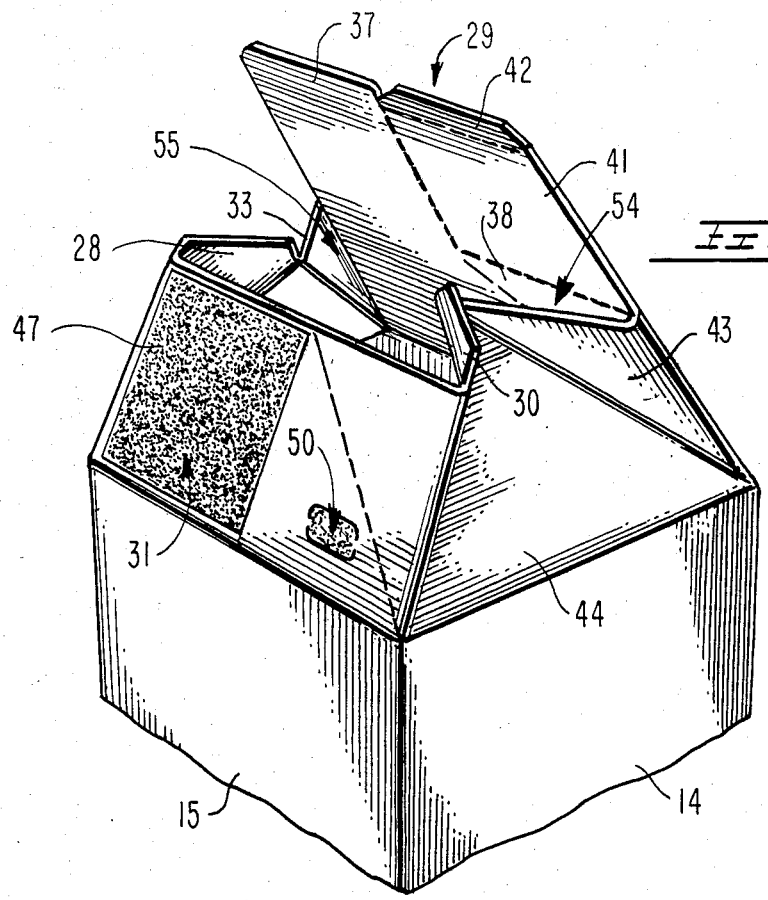
Fig 2.
Fig 3.
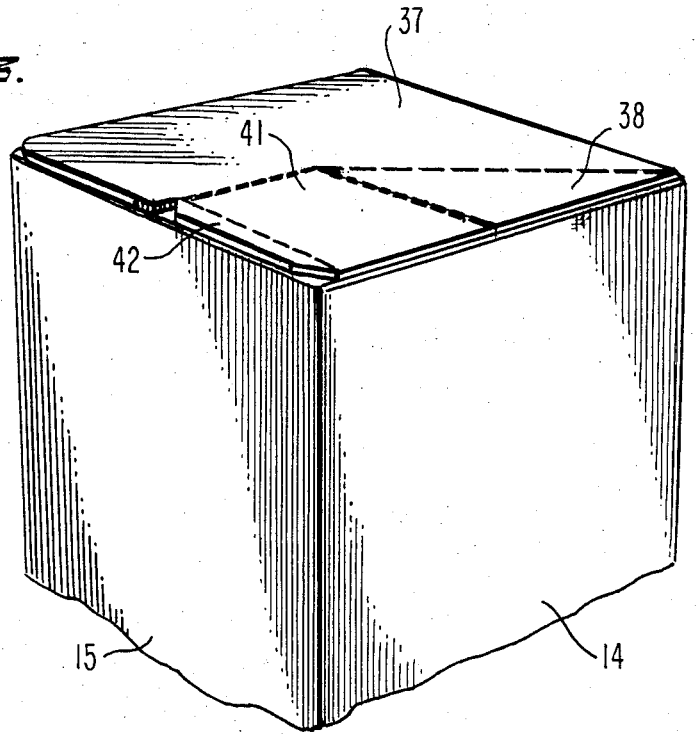

POUR SPOUT CARTON

BACKGROUND

Prior art pour spout cartons are shown, for instance, in U.S. Pat. Nos. 3,743,164 and 3,767,107. In the U.S. Pat. No. 3,743,164, direct access is provided to the pour spout through the top of the carton. For this purpose, the top flap includes a perforated line which is a source of leakage. The top of the carton also includes extra sift proof tabs. However, the tabs shown in the prior art have inwardly tapered side edges which do not effectively block the pinhole which is formed at the apex of the pour spout when the carton is closed. In addition, the sift proof tabs shown are often glued or sealed directly to other panels of the top or pour spout during the top closing step.

In the U.S. Pat. No. 3,767,107, the top closure includes an overlapping flap but no perforated lines. The pour spout portion of the carton is formed by a series of score lines which produce triangular panels and a sift proof tab. However, once the carton is opened for access to the pour spout, there is no means provided for reclosing the top of the carton to protect the pour spout or for guarding against inadvertent spills.

SUMMARY OF INVENTION

The present invention represents an improvement in prior art U.S. Pat. Nos. 3,743,164 and 3,767,107. The carton of the present invention is especially intended for packaging granular or powdered materials such as soap powder, dried milk, sugar, salt and the like, with the primary objective being to provide the consumer with an easy to open and sift proof pour spout dispenser. In particular, the present invention relates to a carton having a pull-out pouring spout under the top of an opening flap which includes features designed to eliminate the temperamental and unreliable opening schemes found in the prior art.

Another object of the present invention is to provide a pour spout carton with means to eliminate sifting as often experienced with prior art cartons, yet which is readily openable under the most adverse top sealing conditions.

An additional object of the present invention is to provide in one embodiment a means for effectively reclosing the pour spout after use.

A further object of the present invention is to provide a carton of the type described which has no outwardly protruding pour spout parts when initially closed, thus preventing accidental opening or interference with the compact packaging of the cartons for shipping and storage.

Further and additional objects will appear from the detailed description, accompanying drawings and appended claims.

In accordance with one embodiment of the invention, a folding carton for a granular or powdered product is provided which includes a self contained reclosable pour spout formed in the top portion of the carton. The carton is formed from a single blank of foldable sheet material and is preferably of generally square cross section. It comprises four side walls having closure flaps connected to the upper and lower ends of the side walls. The closure flaps have adjacent edges thereof connected to one another and to a glue flap which extends along the edge of one side wall and its attached closure flaps. The top closure flap connected to a first side wall and portions of the closure flaps connected to two adjacent side walls form the components of the pour spout. The first side wall closure flap includes a first triangular section having its lower edge connected to the upper edge of the first side wall. Second triangular sections are disposed on opposite sides of the first section which are foldably attached to the remaining side edges of the first triangular section, and to adjacent side edges of third triangular sections formed in the closure flaps of the adjacent side walls. One of the closure flaps connected to an adjacent side wall is adapted to overlap the closure flap of the opposed adjacent side wall when the top of the container is closed, and substantially span the distance between the adjacent side walls. When the carton is closed, the first triangular closure flap attached to the first side wall is folded inwardly and the second and third triangular sections at each side edge thereof are folded together in substantially side-by-side relation. At the same time, tab elements provided on the free ends of one of the second or third triangular sections become inserted in the slots provided between the opposed second and third triangular sections to provide a sift proof closure. The shape of the tab elements is such that protruding ends thereof which meet at the center of the carton during the closing step effectively block the pinholes which are formed at the apex of the pour spout to render the carton top sift proof. The effectiveness of the sift proof closure tabs is enhanced by beginning the protruding ends at points slightly above and to the side of the pour spout apex and its opposed counterpart and by extending the leading edge of each protruding end outwardly at an angle of 15 degrees or more from the vertical. Meanwhile, the overlapping closure flap is provided with a first perforated line extending from an adjacent side wall to a point near the center of the top, where it connects with another perforated line or a fold line extending substantially at a right angle to the first perforated line, to provide a ripped opening flap yielding access to the pour spout of the carton. Further, in order to insure that the pour spout will be readily opened, the tab element located on the second or third triangular section in the region of the pour spout may be provided with a perforated line at the nominal free edge of the second or third triangular section so that it may be ripped therefrom in the event it is inadvertently adhered between the opposite second or third triangular sections when the carton is closed. It will be appreciated that in the case where the ripped opening flap is not completely removed from the overlapping closure flap, it will be available for insertion between the opposite second and third triangular sections to substantially reseal the pour spout after the carton is opened.

DESCRIPTION OF DRAWING

FIG. 2 is a partial perspective view of the top end of the carton formed from the blank of FIG. 1 with the top closure flaps in a partially closed condition;

FIG. 3 is a view similar to FIG. 2 with the top closure flaps completely closed;

DETAILED DESCRIPTION

Figure 1:
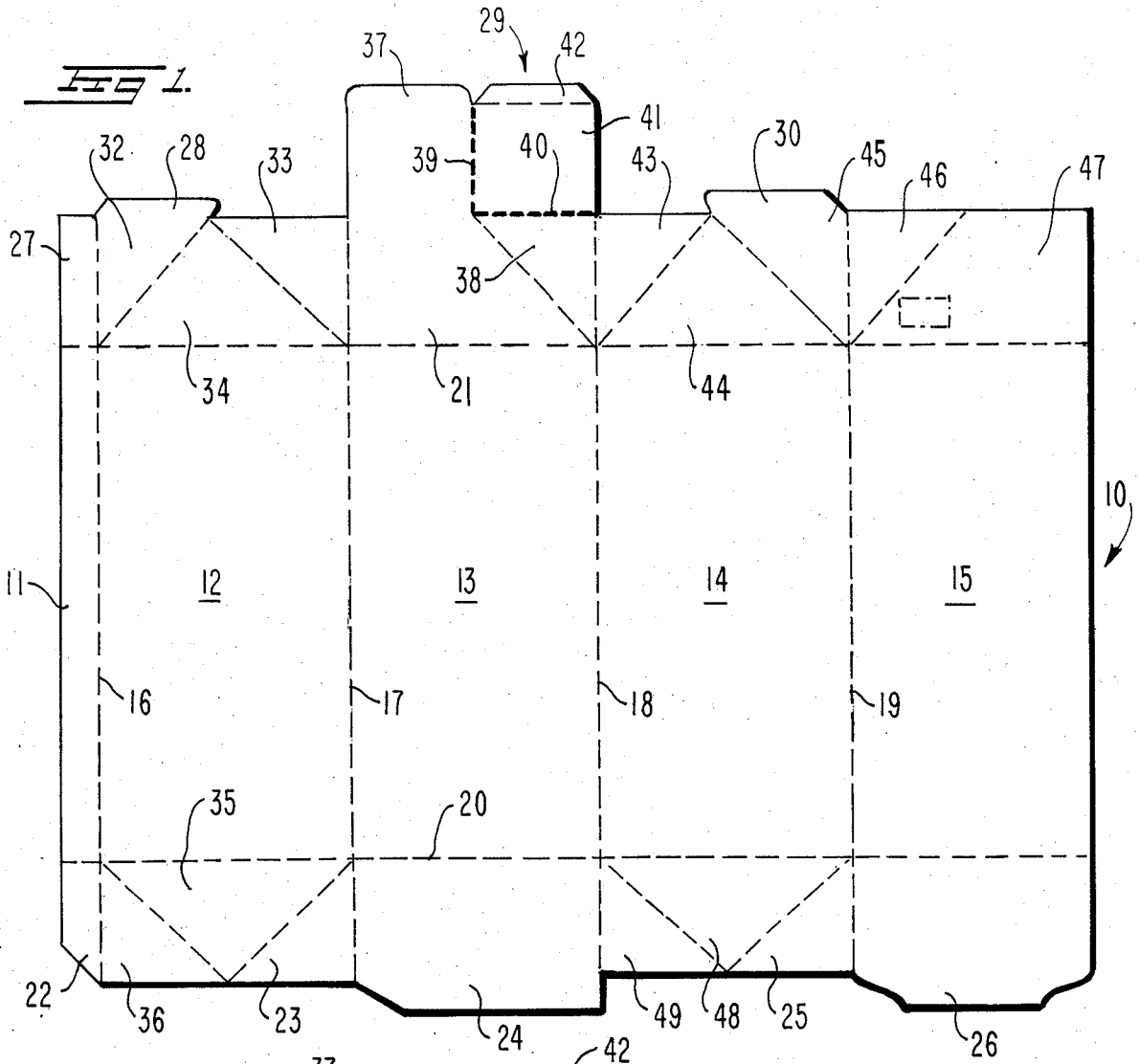
FIG. 1 is a plan view of a typical construction for the blank from which the carton of the present invention is constructed.

For a more complete understanding of the invention, reference should be made to the drawing where FIG. 1 shows a typical blank structure 10 comprising a plurality of side wall panels 12,13,14 and 15 connected to one another along parallel fold lines 17,18 and 19. Attached to one of the side wall panels 12 along a fold line 16 is a glue flap 11 which, with its extensions 22 and 27, serves to adhere the carton together in its set up condition. As shown in FIG. 1, the side walls 12,13,14 and 15 are of substantially equal width to produce a carton that is substantially square in cross section. It will be understood, however, that the only requirement for the blank is that the opposed side walls are made of equal width. Each of the side wall panels 12,13,14 and 15 also include bottom closure flaps foldably attached thereto along a lower fold line 20. The bottom closure flaps include a first pair 24 and 26 which are of generally the same size and shape, and a second pair divided into triangular sections 35,36 and 23, and 48,49 and 25. These flap sections are all foldably connected together so that when they are sealed together they provide a fully leak proof bottom closure. At the upper end of each side wall panel 12,13,14 and 15 a plurality of top closure flaps are foldably attached thereto along an upper score line 21. The top closure flap attached to side wall 12 is divided into triangular panels 32,33 and 34 by score lines arranged in a substantially symmetrical manner. A sift proof tab element 28 is illustrated as being coextensive with triangular section 32. The sift proof tab element 28 is formed with a protruding end adjacent to the apex of the triangular portion 34. The protruding end extends from the upper edge of the triangular portion 33 beginning at a point slightly above and to the side of the apex of triangular portion 34. This point may be located, for example, approximately 0.05 to 0.125 inch above and to the side of the apex. From this point, the edge of the protruding end preferably extends outwardly at an angle of from 10 to 20 degrees from the vertical to describe an angle between it and the upper edge of triangular portion 33 of less than 90 degrees. The result is that carton material is added or left at the opposite side of the apex. The purpose of this arrangement is two fold (1) to eliminate and cover up the pinhole formed at the apex when the carton is closed and sealed, and (2) to create an upward bias of the top closure flaps which allows greater pressure to be applied during sealing and improves the glue bond.

For purpose of description only, the triangular panel 34 is designated a first triangular section while panels 32 and 33 are designated second triangular sections. The top closure flap 37 attached to side wall 13 includes the ripped opening flap 29. The opening flap is formed in the FIG. 1 embodiment by a panel 41 which is defined by a pair of perforated lines 39 and 40 which extend from adjacent edges of one corner of the flap toward the center where they intersect one another. The perforated lines 39,40 are arranged substantially perpendicular to one another but need not be so oriented, and in the FIG. 1 embodiment, describe a removable panel 41 with its own lift tab 42. Meanwhile, adjacent to perforated line 40 in the top closure flap 37, a diagonally oriented score line is provided to define a triangular panel 38 which, for descriptive purposes only is referred to as a third triangular section. The top closure flap attached to side wall 14 includes the panels which form the pour spout. They include a first triangular section 44, a pair of second triangular sections 43,45 and a sift proof tab extension 30 formed as a mirror image of tab 28, coextensive with second triangular section 45. Finally, the closure flap 47 attached to side wall 15 includes a third triangular section 46. The blank 10 is set up and glued for use by adhering glue flaps 11,22 and 27 to panels 15,26 and 47 respectively. Prior to filling, the bottom closure flaps are folded and sealed and after filling, the top closure is ready for sealing.

As shown in FIG. 2, the top closure panels are sealed with the application of adhesive 31 to the portion of flap 47 which is overlapped by flap 37, and by the use of an adhesive spot 50 for sealing the ripped opening flap 29 in place. The first triangular sections 34 and 44 attached to side wall panels 12 and 14 respectively are folded inwardly and the second and third triangular sections adjacent thereto are folded together. In this condition, the second and third triangular sections 43 and 38 in the region of the pour spout form a slot 54 into which the tab 30 is inserted. At the rear of the carton, the second triangular section 33 and the closure flap portion 37 also form a slot 55 into which the tab 28 is inserted. These tabs 28 and 30 effectively prevent sifting of the packaged product when the carton is sealed because the protruding ends thereof overlap one another and plug the gap that would normally be found at the apexes of triangular sections 34 and 44.

Figure 4:
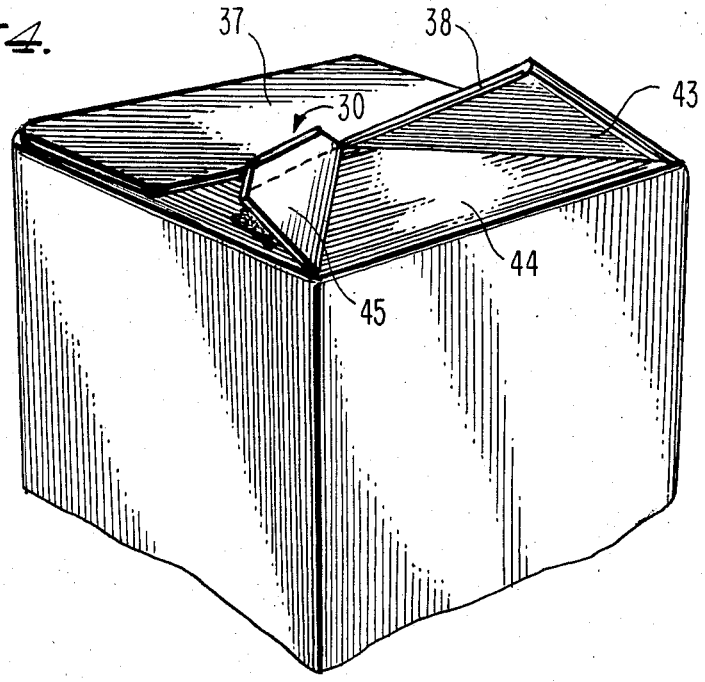
FIG. 4 is a partial perspective view showing the pour spout in its initial opening stage.
Figure 5:
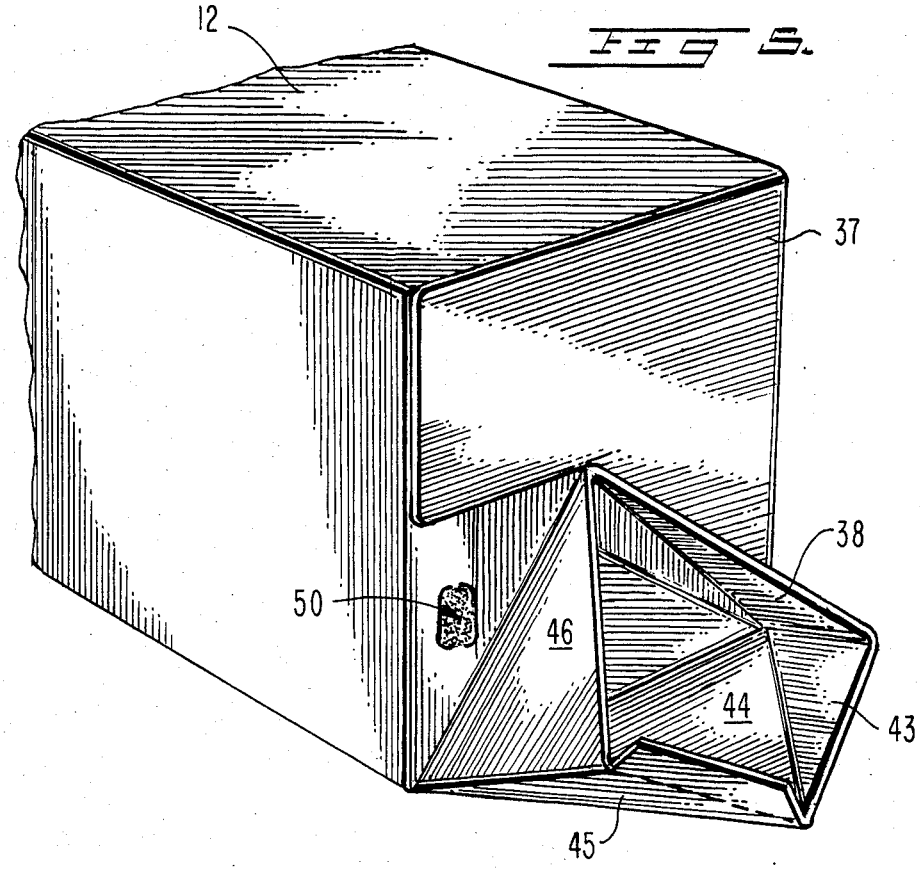
FIG. 5 is a partial perspective view showing the pour spout opened in the pouring condition.

FIG. 3 illustrates the top of the carton in its closed condition. The pour spout is folded down or retracted to produce a flat topped configuration with no outwardly protruding elements. The top closure flap portion 37 is adhered and remains adhered to flap 47 while the lift flap panel 41 is spot glued to flap 47. The carton is opened as shown in FIG. 4, to expose the pour spout, by lifting up tab 42 of lift flap 29 and ripping off the panel 41 along perforated lines 39 and 40. The pour spout is then pulled out as shown in FIG. 5 by grasping tab 42 and pulling outwardly. This action causes the first triangular section to fold outwardly and the second triangular sections 43,45 fold apart from the third triangular sections 38,46.

In the situation where the top of the carton is heat sealed using the carton coating material as an adhesive, or where adhesive is not properly applied to the top panels, the tab 30 often becomes sealed to one or both of the second or third triangular sections 38,43. When this happens, the pour spout cannot readily be pulled out of the carton. In order to counteract this problem, tab 30 may be made removable from the carton as shown for example in FIG. 6(A). For this purpose, the tab 30 in FIG. 6(A) is illustrated as being attached to the edge of triangular section 45 by a perforated line 56. In the event that the tab 30 becomes sandwiched between and adhered to triangular sections 38,43 or both, it can readily be removed by tearing along perforated line 56 to release the pour spout.

Figure 6:
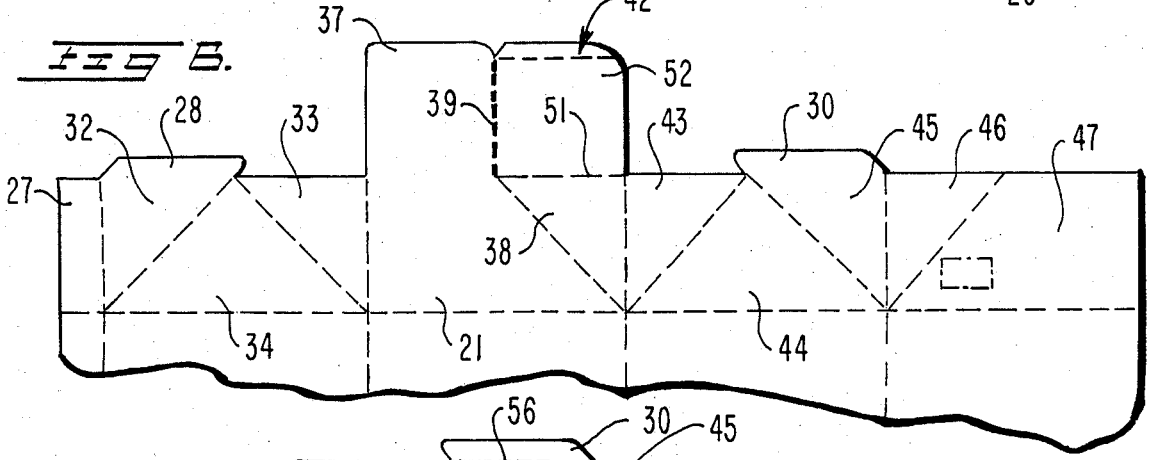
FIG. 6 is a partial plan view of a modified blank construction.
Figure 6A:
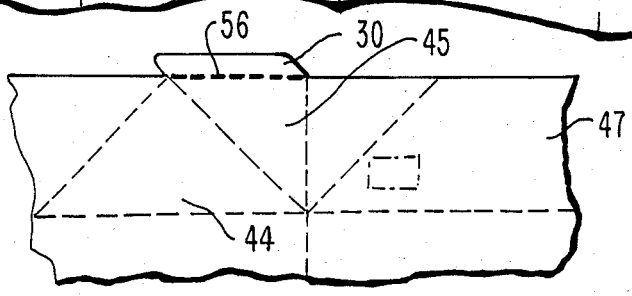
FIG. 6(A) is a partial plan view showing yet another modification to the typical blank construction.
Figure 7:
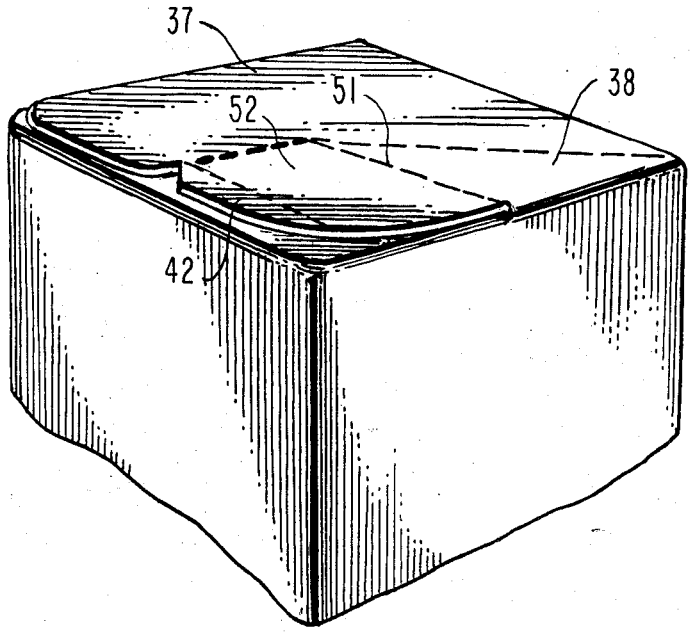
FIG. 7 is a partial perspective view of the top of the carton formed from the blank of FIG. 6 with the top closed.
Figure 8:
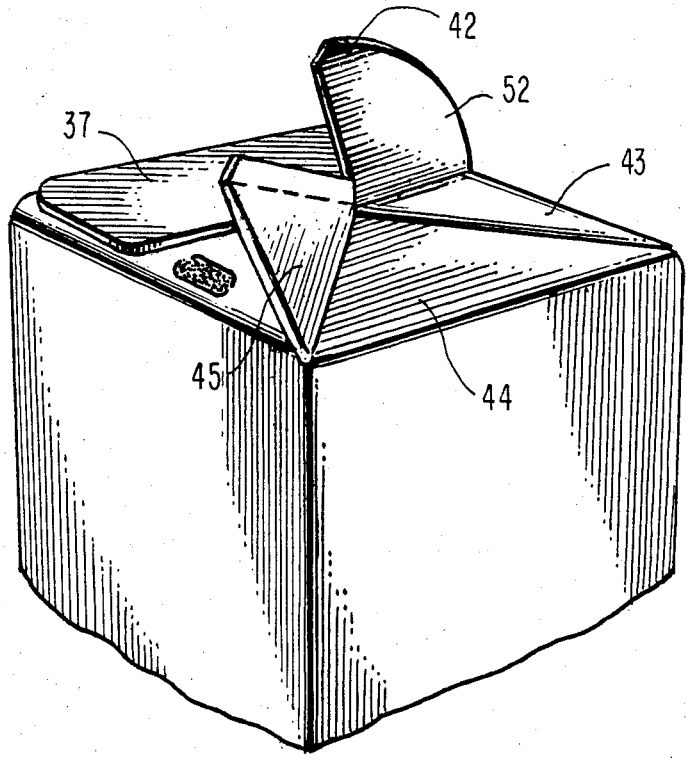
FIG. 8 is a view similar to FIG. 7 with the top closure flaps partially opened.
Figure 9:
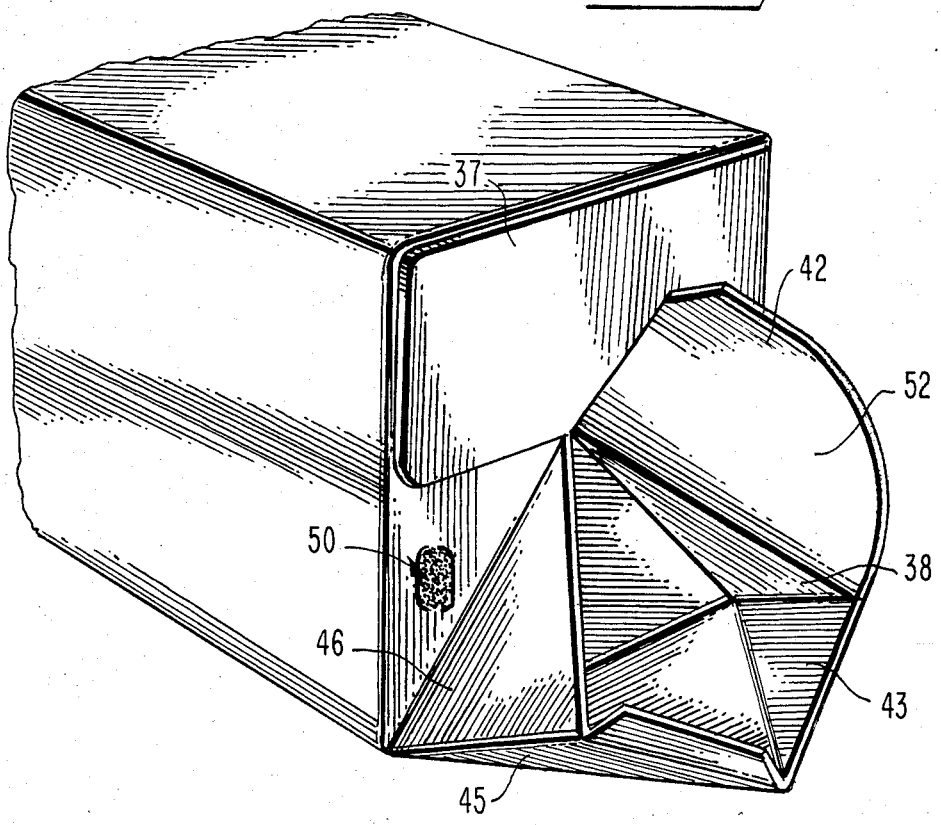
FIG. 9 shows the carton of FIG. 8 with the pour spout opened.
Figure 10:
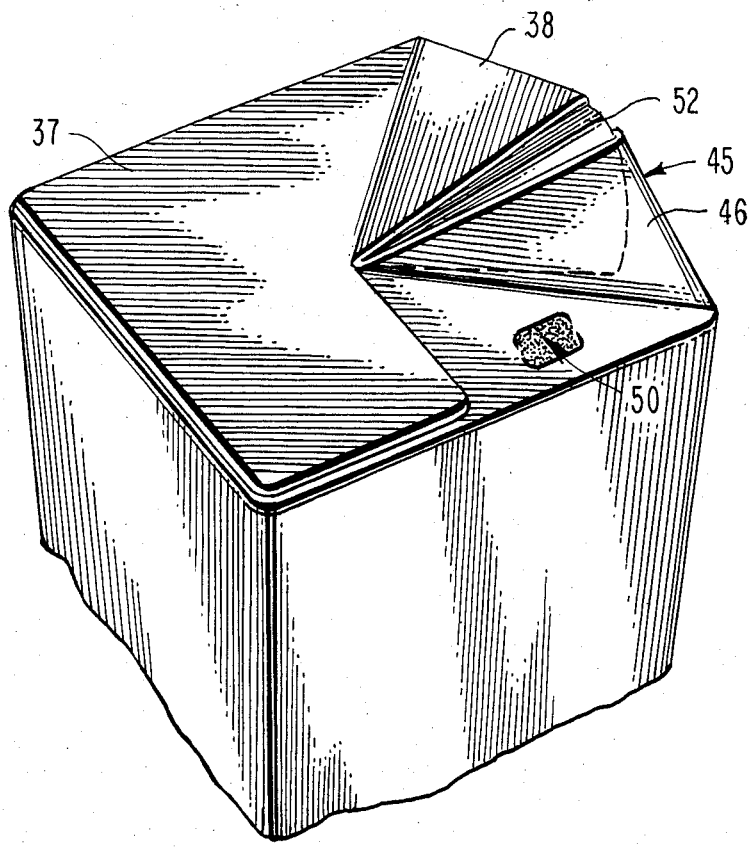
FIG. 10 shows the carton of FIG. 8 with the pour spout reclosed.

In the event that a pour spout design is required which can be resealed or effectively reclosed, the blank structure shown in FIG. 1 could be modified substantially as shown in FIG. 6. In the FIG. 6 embodiment, the perforated line 40 previously employed in FIG. 1 is eliminated and changed to a fold line 51. This step does not change the function of the pour spout or the filling and sealing steps, but it provides a construction wherein the carton opening flap 52 remains attached to the top closure flap 37 along the fold line 51 making it available as a reclosing means. FIG. 7 shows the top of a carton prepared from the blank of FIG. 6 in its closed and sealed condition. As in the previously described embodiment, flap 37 is adhered permanently to flap 47 while the lift flap panel 52 is temporarily adhered to flap 47. The carton is opened by grasping tab 42 and detaching panel 52. These panels are further folded outwardly to displace the pour spout as shown in FIG. 9. After dispensing, the carton with flap 52 attached may be reclosed and substantially resealed by inserting flap 52 into the slot 53 created between second triangular section 45 and third triangular section 46. The reclosure step is shown in FIG. 10.

Thus it will be seen that the present invention discloses an improved carton with a self contained reclosable pour spout. The carton is substantially leak proof when closed and includes an improved means for opening and resealing the pour spout after opening.

What is claimed is:

1. A folding carton having a self-contained, reclosable pour spout, comprising, a plurality of foldably connected side walls having ends, a plurality of top and bottom closure flaps foldably attached to the ends of said side walls, said top closure flaps having edges, a pour spout formed in the top closure flaps attached to a first side wall and two adjacent side walls, sift proof tabs integral with and extending beyond the edges of the top closure flaps attached to the first side wall and the side wall opposite said first side wall, said sift proof tabs each being formed with protruding leading edges which extend outwardly at an angle of from 10–20 degrees from the vertical to form an angle with the upper edges of the top closure flaps of less than 90 degrees to permit the ends thereof to overlap one another at the center of the carton when the carton is closed, slots formed between the top closure flap attached to an adjacent side wall and portions of the top closure flaps attached to the first side wall and the side wall opposite said first side wall when the carton is closed for accepting said sift proof tabs, and access means for said pour spout provided in the top closure flap attached to an adjacent side wall having a free edge, said access means comprising a cover panel formed in one corner of that top closure flap, said cover panel being defined by a perforated line extending from the free edge of that closure flap to a point near the center of said carton and a fold line extending from the edge of that closure flap near the first side wall to a point near the center of said carton where the two lines intersect, said cover panel including an integral lift tab located along its free edge, and means for temporarily attaching said cover panel to the top of said carton.

2. The folding carton of claim 1 wherein said cover panel is detachable from that top closure flap and is defined by a pair of perforated lines in that top closure flap, said perforated lines extending from adjacent edges of the corner of that top closure flap to intersect in the center of that top closure flap.

* * * * *